US010291975B2

(12) United States Patent
Howell et al.

(10) Patent No.: US 10,291,975 B2
(45) Date of Patent: May 14, 2019

(54) WIRELESS EAR BUDS

(71) Applicant: Apple Inc., Cupertino, CA (US)

(72) Inventors: Adam S. Howell, Oakland, CA (US); Hung A. Pham, Oakland, CA (US); Akifumi Kobashi, Sunnyvale, CA (US); Rami Y. Hindiyeh, Pacifica, CA (US); Xing Tan, San Jose, CA (US); Alexander Singh Alvarado, Sunnyvale, CA (US); Karthik Jayaraman Raghuram, Mountainview, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/622,448

(22) Filed: Jun. 14, 2017

(65) Prior Publication Data

US 2018/0070166 A1 Mar. 8, 2018

Related U.S. Application Data

(60) Provisional application No. 62/383,944, filed on Sep. 6, 2016.

(51) Int. Cl.
*H04R 1/10* (2006.01)
*H04R 29/00* (2006.01)

(52) U.S. Cl.
CPC ..... *H04R 1/1041* (2013.01); *H04R 1/1016* (2013.01); *H04R 29/001* (2013.01); *H04R 2420/07* (2013.01)

(58) Field of Classification Search
CPC .. H04R 1/1016; H04R 1/1041; H04R 1/1083; H04R 2460/11; H04R 3/005; H04R 3/04;
(Continued)

(56) References Cited

U.S. PATENT DOCUMENTS 9,113,246 B2 8/2015 Bastide et al.
9,351,089 B1 * 5/2016 Chu ..... H04R 29/00
(Continued)

FOREIGN PATENT DOCUMENTS

CN 102006528 A 4/2011
CN 102365875 B 9/2014
(Continued)

*Primary Examiner* — Lun-See Lao
(74) *Attorney, Agent, or Firm* — Treys Law Group, P.C.; G. Victor Treyz; Kendall W. Abbasi

(57) ABSTRACT

Ear buds may have optical proximity sensors and accelerometers. Control circuitry may analyze output from the optical proximity sensors and the accelerometers to identify a current operational state for the ear buds. The control circuitry may also analyze the accelerometer output to identify tap input such as double taps made by a user on ear bud housings. Samples in the accelerometer output may be analyzed to determine whether the samples associated with a tap have been clipped. If the samples have been clipped, a curve may be fit to the samples. Optical sensor data may be analyzed in conjunction with potential tap input data from the accelerometer. If the optical sensor data is ordered, a tap input may be confirmed. If the optical sensor data is disordered, the control circuitry can conclude that accelerometer data corresponds to false tap input associated with unintentional contact with the housing.

17 Claims, 16 Drawing Sheets

(58) Field of Classification Search
CPC ..... H04R 1/1091; G10K 11/1782; G10K 11/1784; G10K 2210/1081; H04N 13/0468; H04N 7/142; H04N 7/15
USPC ..... 381/74, 334, 333, 312–315; 455/418
See application file for complete search history.

(56) References Cited

U.S. PATENT DOCUMENTS

| | | | | |
|---|---|---|---|---|
| 9,462,109 | B1 * | 10/2016 | Frazier Fields | H04M 1/6066 |
| 9,648,409 | B2 * | 5/2017 | Puskarich | H04R 1/1041 |
| 10,110,984 | B2 * | 10/2018 | Rich | H04R 1/1016 |
| 2012/0003937 | A1 | 1/2012 | Zhong | |
| 2012/0114154 | A1 | 5/2012 | Abrahamsson | |
| 2013/0279724 | A1 | 10/2013 | Stafford et al. | |
| 2014/0016803 | A1 | 1/2014 | Puskarich | |
| 2014/0288876 | A1 * | 9/2014 | Donaldson | A61B 5/1118 702/141 |
| 2015/0316577 | A1 * | 11/2015 | Pakzad | G01P 13/02 702/150 |
| 2016/0057555 | A1 * | 2/2016 | Schuster | H04R 3/04 381/59 |
| 2017/0060269 | A1 * | 3/2017 | Forstner | G06F 3/0346 |

FOREIGN PATENT DOCUMENTS

| | | | |
|---|---|---|---|
| CN | 104125523 | A | 10/2014 |
| CN | 104581480 | A | 4/2015 |
| CN | 104660799 | A | 5/2015 |
| CN | 204968086 | U | 1/2016 |
| CN | 105446476 | A | 3/2016 |
| CN | 105611443 | A | 5/2016 |
| CN | 105721973 | A | 6/2016 |
| CN | 207410484 | U | 5/2018 |
| EP | 2363784 | A2 | 9/2011 |
| EP | 2451187 | A2 | 5/2012 |
| JP | 2009278445 | | 11/2009 |
| JP | 2010193349 | | 9/2010 |
| JP | 2013066226 | | 4/2013 |
| JP | 2015128320 | A | 7/2015 |
| JP | 2016062615 | | 4/2016 |
| WO | 2015164287 | A1 | 10/2015 |
| WO | 2015167695 | | 10/2015 |

* cited by examiner

WIRELESS EAR BUDS

This application claims the benefit of provisional patent application No. 62/383,944, filed Sep. 6, 2016, which is hereby incorporated by reference herein in its entirety.

BACKGROUND

This relates generally to electronic devices, and, more particular, to wearable electronic devices such as ear buds.

Cellular telephones, computers, and other electronic equipment may generate audio signals during media playback operations and telephone calls. Microphones and speakers may be used in these devices to handle telephone calls and media playback. Sometimes ear buds have cords that allow the ear buds to be plugged into an electronic device.

Wireless ear buds provide users with more flexibility than wired ear buds, but can be challenging to use. For example, it can be difficult to determine whether an ear bud is in a user's pocket, is resting on a table, is in a case, or is in the user's ear. As a result, controlling the operation of the ear bud can be challenging.

It would therefore be desirable to be able to provide improved wearable electronic devices such as improved wireless ear buds.

SUMMARY

Ear buds may be provided that communicate wirelessly with an electronic device. To determine the current status of the ear buds and thereby take suitable action in controlling the operation of the electronic device and ear buds, the ear buds may be provided with optical proximity sensors that produce optical proximity sensor output and accelerometers that produce accelerometer output.

Control circuitry may analyze the optical proximity sensor output and the accelerometer output to determine the current operating state for the ear buds. The control circuitry may determine whether an ear bud is located in an ear of a user or is in a different operating state.

The control circuitry may also analyze the accelerometer output to identify tap input such as double taps made by a user on the housing of an ear bud. Samples of the accelerometer output may be analyzed to determine whether the samples for a tap have been clipped. If the samples have been clipped, a curve may be fit to the samples to enhance the accuracy with which pulse attributes are measured.

Optical sensor data may be analyzed in conjunction with potential tap input. If the optical sensor data associated with a pair of accelerometer pulses is ordered, the control circuitry can confirm the detection of a true double tap from the user. If the optical sensor data is disordered, the control circuitry can conclude that the pulse data from the accelerometer corresponds to unintentional contact with the housing and can disregard the pulse data.

DETAILED DESCRIPTION

An electronic device such as a host device may have wireless circuitry. Wireless wearable electronic devices such as wireless ear buds may communicate with the host device and with each other. In general, any suitable types of host electronic device and wearable wireless electronic devices may be used in this type of arrangement. The use of a wireless host such as a cellular telephone, computer, or wristwatch may sometimes be described herein as an example. Moreover, any suitable wearable wireless electronic devices may communicate wirelessly with the wireless host. The use of wireless ear buds to communicate with the wireless host is merely illustrative.

Figure 1:
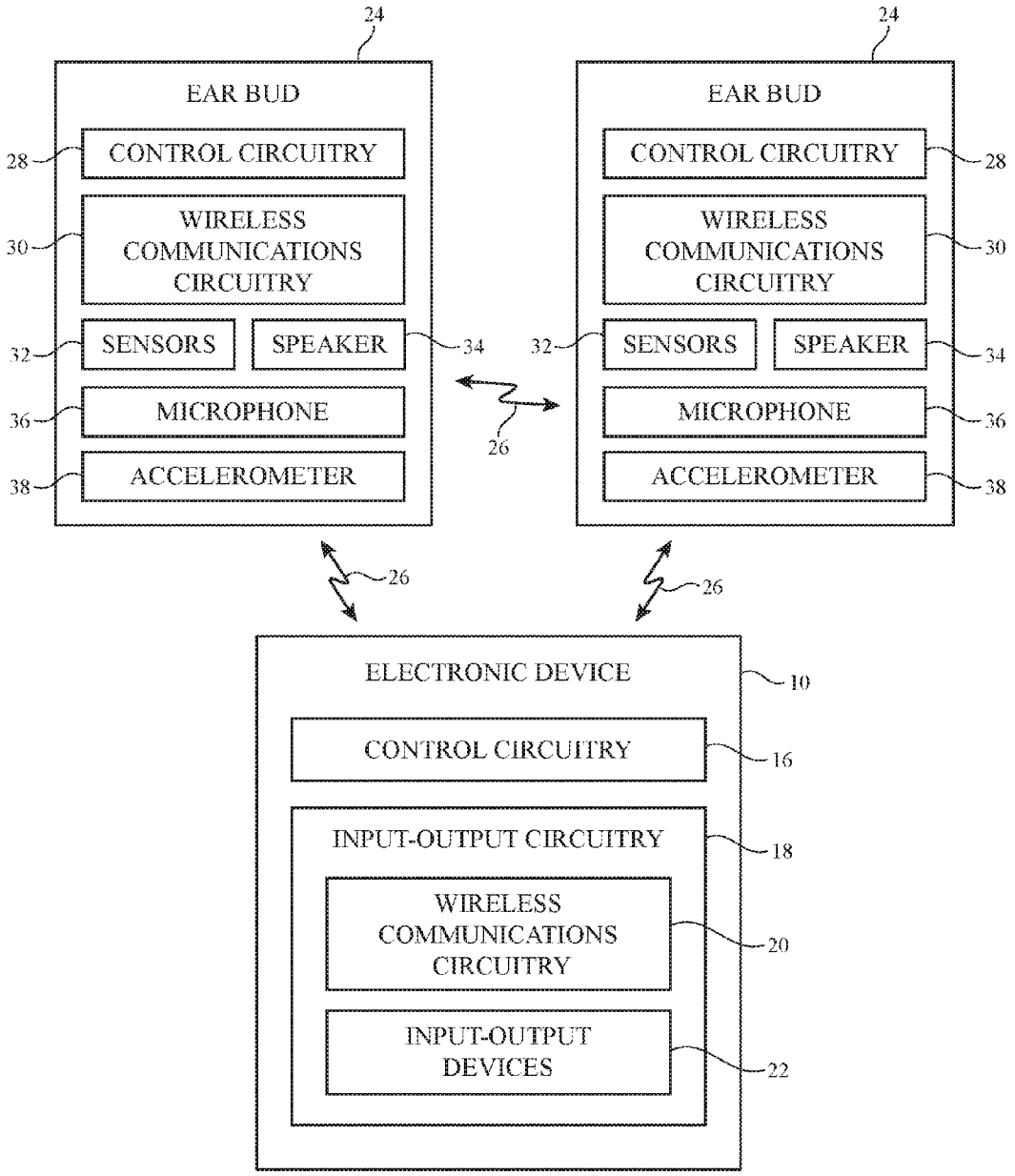
FIG. 1 is a schematic diagram of an illustrative system including electronic equipment that communicates wirelessly with wearable electronic devices such as wireless ear buds in accordance with an embodiment.

A schematic diagram of an illustrative system in which a wireless electronic device host communicates wirelessly with accessory devices such as ear buds is shown in FIG. 1. Host electronic device 10 may be a cellular telephone, may be a computer, may be a wristwatch device or other wearable equipment, may be part of an embedded system (e.g., a system in a plane or vehicle), may be part of a home network, or may be any other suitable electronic equipment. Illustrative configurations in which electronic device 10 is a watch, computer, or cellular telephone, may sometimes be described herein as an example.

As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc. If desired, the processing circuitry may include at least two processors (e.g., a microprocessor serving as an application processor and an application-specific integrated circuit processor for processing motion signals and other signals from sensors—sometimes referred to as a motion processor). Other types of processing circuit arrangements may be used, if desired.

Device 10 may have input-output circuitry 18. Input-output circuitry 18 may include wireless communications circuitry 20 (e.g., radio-frequency transceivers) for supporting communications with wireless wearable devices such as ear buds 24 or other wireless wearable electronic devices via wireless links 26. Ear buds 24 may have wireless communications circuitry 30 for supporting communications with circuitry 20 of device 10. Ear buds 24 may also communicate with each other using wireless circuitry 30. In general, the wireless devices that communicate with device 10 may be any suitable portable and/or wearable equipment. Configurations in which wireless wearable devices 24 are ear buds are sometimes described herein as an example.

Input-output circuitry in device 10 such as input-output devices 22 may be used to allow data to be supplied to device 10 and to allow data to be provided from device 10 to external devices. Input-output devices 22 may include buttons, joysticks, scrolling wheels, touch pads, key pads, keyboards, microphones, speakers, displays (e.g., touch screen displays), tone generators, vibrators (e.g., piezoelectric vibrating components, etc.), cameras, sensors, light-emitting diodes and other status indicators, data ports, etc. A user can control the operation of device 10 by supplying commands through input-output devices 22 and may receive status information and other output from device 10 using the output resources of input-output devices 22. If desired, some or all of these input-output devices may be incorporated into ear buds 24.

Each ear bud 24 may have control circuitry 28 (e.g., control circuitry such as control circuitry 16 of device 10), wireless communications circuitry 30 (e.g., one or more radio-frequency transceivers for supporting wireless communications over links 26), may have one or more sensors 32 (e.g., one or more optical proximity sensors including light-emitting diodes for emitting infrared light or other light and including light detectors that detect corresponding reflected light), and may have additional components such as speakers 34, microphones 36, and accelerometers 38. Speakers 34 may play audio into the ears of a user. Microphones 36 may gather audio data such as the voice of a user who is making a telephone call. Accelerometer 38 may detect when ear buds 24 are in motion or are at rest. During operation of ear buds 24, a user may supply tap commands (e.g., double taps, triple taps, other patterns of taps, single taps, etc.) to control the operation of ear buds 24. Tap commands may be detected using accelerometer 38. Optical proximity sensor input and other data may be used when processing tap commands to avoid false tap detections.

Control circuitry 28 on ear buds 24 and control circuitry 16 of device 10 may be used to run software on ear buds 24 and device 10, respectively. During operation, the software running on control circuitry 28 and/or 16 may be used in gathering sensor data, user input, and other input and may be used in taking suitable actions in response to detected conditions. As an example, control circuitry 28 and 16 may be used in handling audio signals in connection with incoming cellular telephone calls when it is determined that a user has placed one of ear buds 24 in the ear of the user. Control circuitry 28 and/or 16 may also be used in coordinating operation between a pair of ear buds 24 that are paired with a common host device (e.g., device 10), handshaking operations, etc.

In some situations, it may be desirable to accommodate stereo playback from ear buds 24. This can be handled by designating one of ear buds 24 as a primary ear bud and one of ear buds 24 as a secondary ear bud. The primary ear bud may serve as a slave device while device 10 serves as a master device. A wireless link between device 10 and the primary ear bud may be used to provide the primary ear bud with stereo content. The primary ear bud may transmit one of the two channels of the stereo content to the secondary ear bud for communicating to the user (or this channel may be transmitted to the secondary ear bud from device 10). Microphone signals (e.g., voice information from the user during a telephone call) may be captured by using microphone 36 in the primary ear bud and conveyed wirelessly to device 10.

Sensors 32 may include strain gauge sensors, proximity sensors, ambient light sensors, touch sensors, force sensors, temperature sensors, pressure sensors, magnetic sensors, accelerometers (see, e.g., accelerometers 38), gyroscopes and other sensors for measuring orientation (e.g., position sensors, orientation sensors), microelectromechanical systems sensors, and other sensors. Proximity sensors in sensors 32 may emit and/or detect light and/or may be capacitive proximity sensors that generate proximity output data based on measurements by capacitance sensors (as examples). Proximity sensors may be used to detect the presence of a portion of a user's ear to ear bud 24 and/or may be triggered by the finger of a user (e.g., when it is desired to use a proximity sensor as a capacitive button or when a user's fingers are gripping part of ear bud 24 as ear bud 24 is being inserted into the user's ear). Configurations in which ear buds 24 use optical proximity sensors may sometimes be described herein as an example.

Figure 2:
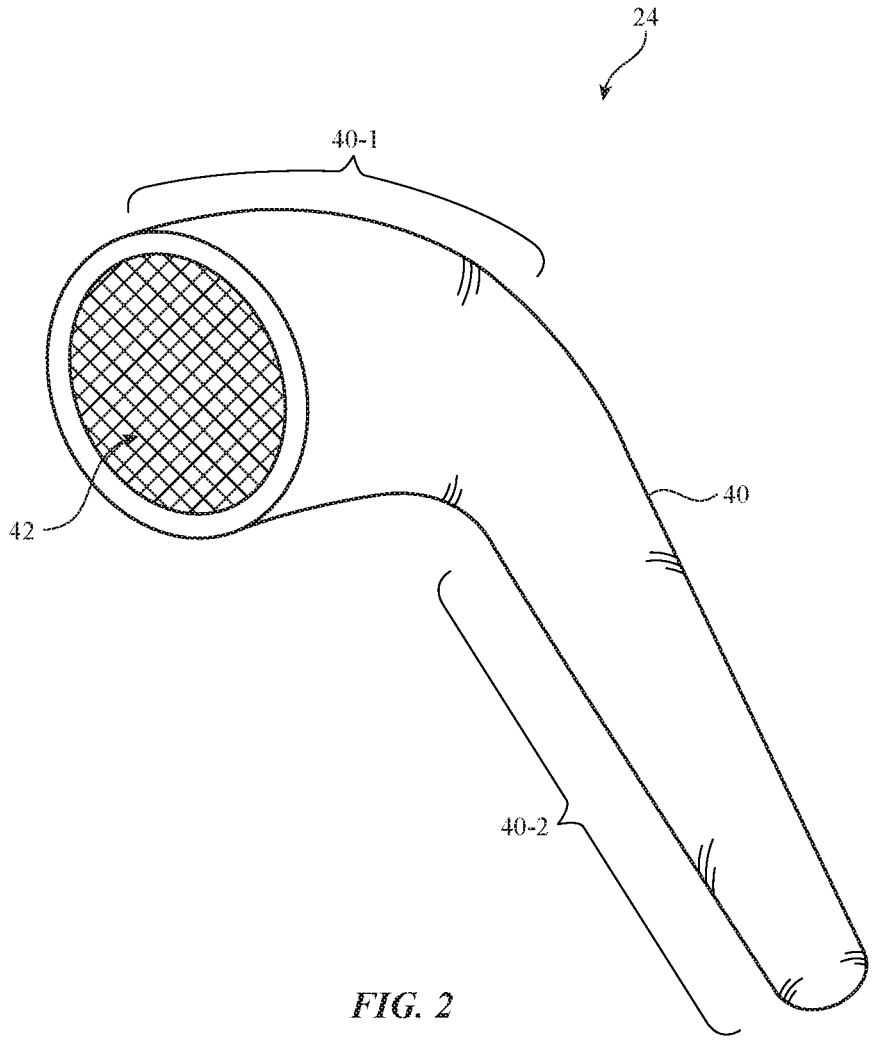
FIG. 2 is a perspective view of an illustrative ear bud in accordance with an embodiment.

FIG. 2 is a perspective view of an illustrative ear bud. As shown in FIG. 2, ear bud 24 may include a housing such as housing 40. Housing 40 may have walls formed from plastic, metal, ceramic, glass, sapphire or other crystalline materials, fiber-based composites such as fiberglass and carbon-fiber composite material, natural materials such as wood and cotton, other suitable materials, and/or combinations of these materials. Housing 40 may have a main portion such as main body 40-1 that houses audio port 42 and a stem portion such as stem 40-2 or other elongated portion that extends away from main body portion 40-1. During operation, a user may grasp stem 40-2 and, while holding stem 40-2, may insert main portion 40-1 and audio port 42 into the ear. When ear buds 24 are worn in the ears of a user, stem 40-2 may be oriented vertically in alignment with the Earth's gravity (gravity vector).

Audio ports such as audio port 42 may be used for gathering sound for a microphone and/or for providing sound to a user (e.g., audio associated with a telephone call, media playback, an audible alert, etc.). For example, audio port 42 of FIG. 2 may be a speaker port that allows sound from speaker 34 (FIG. 1) to be presented to a user. Sound may also pass through additional audio ports (e.g., one or more perforations may be formed in housing 40 to accommodate microphone 36).

Figure 3:
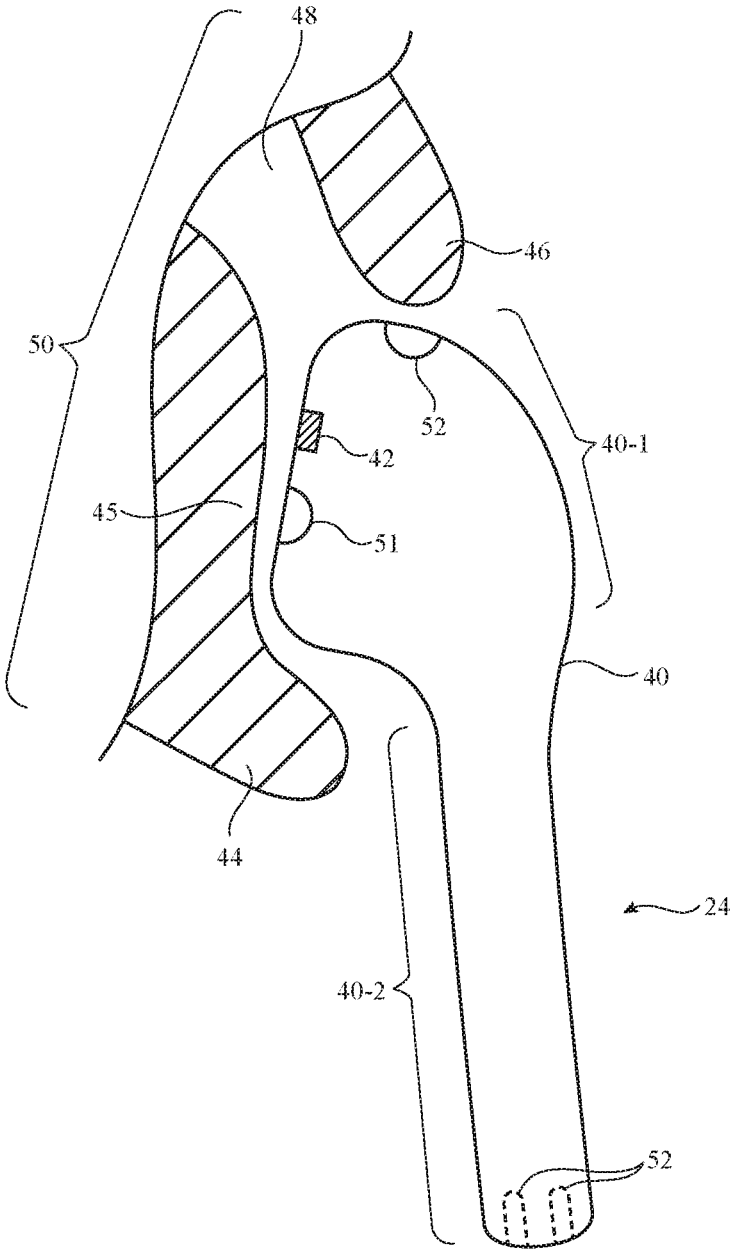
FIG. 3 is a side view of an illustrative ear bud located in an ear of a user in accordance with an embodiment.

Sensor data (e.g., proximity sensor data, accelerometer data or other motion sensor data), wireless communications circuitry status information, and/or other information may be used in determining the current operating state of each ear bud 24. Proximity sensor data may be gathered using proximity sensors located at any suitable locations in housing 40. FIG. 3 is a side view of ear bud 24 in an illustrative configuration in which ear bud 24 has two proximity sensors S1 and S2. Sensors S1 and S2 may be mounted in main body portion 40-1 of housing 40. If desired, additional sensors (e.g., one, two, or more than two sensors that are expected to produce no proximity output when ear buds 24 are being worn in a user's ears and which may therefore sometimes be referred to as null sensors) may be mounted on stem 40-2. Other proximity mounting arrangements may also be used. In the example of FIG. 3, there are two proximity sensors on housing 40. More proximity sensors or fewer proximity sensors may be used in ear bud 24, if desired.

Sensors S1 and S2 may be optical proximity sensors that use reflected light to determine whether an external object is nearby. An optical proximity sensor may include a source of light such as an infrared light-emitting diode. The infrared light-emitting diode may emit light during operation. A light detector (e.g., a photodiode) in the optical proximity sensor may monitor for reflected infrared light. In situations in which no objects are near ear buds 24, emitted infrared light will not be reflected back towards the light detector and the output of the proximity sensor will be low (i.e., no external objects in the proximity of ear buds 24 will be detected). In situations in which ear buds 24 are adjacent to an external object, some of the emitted infrared light from the infrared light detector will be reflected back to the light detector and will be detected. In this situation, the presence of the external object will cause the output signal from the proximity sensor to be high. Intermediate levels of proximity sensor output may be produced when external objects are at intermediate distances from the proximity sensor.

As shown in FIG. 3, ear bud 24 may be inserted into the ear (ear 50) of a user, so that speaker port 42 is aligned with ear canal 48. Ear 50 may have features such as concha 46, tragus 45, and antitragus 44. Proximity sensors such as proximity sensors S1 and S2 may output positive signals when ear bud 24 is inserted into ear 50. Sensor S1 may be a tragus sensor and sensor S2 may be a concha sensor or sensors such as sensors S1 and/or S2 may be mounted adjacent to other portions of ear 50.

It may be desirable to adjust the operation of ear buds 24 based on the current state of ear buds 24. For example, it may be desired to activate more functions of ear buds 24 when ear buds 24 are located in a user's ears and are being actively used than when ear buds 24 are not in use. Control circuitry 28 may keep track of the current operating state (operating mode) of ear buds 24 by implementing a state machine. With one illustrative configuration, control circuitry 28 may maintain information on the current status of ear buds 24 using a two-state state machine. Control circuitry 28 may, for example, use sensor data and other data to determine whether ear buds 24 are in a user's ears or are not in a user's ears and may adjust the operation of ear buds 24 accordingly. With more complex arrangements (e.g., using state machines with three, four, five, six, or more states), more detailed behaviors can be tracked and appropriate state-dependent actions taken by control circuitry 28. If desired, optical proximity sensor processing circuitry or other circuitry may be powered down to conserve battery power when not in active use.

Control circuitry 28 may use optical proximity sensors, accelerometers, contact sensors, and other sensors to form a system for in-ear detection. The system may, for example, detect when an earbud is inserted into a user's ear canal or is in other states using optical proximity sensor and accelerometer (motion sensor) measurements.

An optical proximity sensor (see, e.g., sensors S1 and S2) may provide a measurement of distance between the sensor and an external object. This measurement may be represented at a normalized distance D (e.g., a value between 0 and 1). Accelerometer measurements may be made using three-axis accelerometers (e.g., accelerometers that produce output for three orthogonal axes—an X axis, a Y axis, and a Z axis). During operation, sensor output may be digitally sampled by control circuitry 28. Calibration operations may be performed during manufacturing and/or at appropriate times during normal use (e.g., during power up operations when ear buds 24 are being removed from a storage case, etc.). These calibration operations may be used to compensate for sensor bias, scale error, temperature effects, and other potential sources of sensor inaccuracy. Sensor measurements (e.g., calibrated measurements) may be processed by control circuitry 28 using low-pass and high-pass filters and/or using other processing techniques (e.g., to remove noise and outlier measurements). Filtered low-frequency-content and high-frequency-content signals may be supplied to a finite state machine algorithm running on control circuitry 28 to help control circuitry 28 track the current operating state of ear buds 24.

In addition to optical sensor and accelerometer data, control circuitry 28 may use information from contact sensors in ear buds 24 to help determine earbud location. For example, a contact sensor may be coupled to the electrical contacts (see, e.g., contacts S2 of FIG. 3) in an ear bud that are used for charging the ear bud when the ear bud is in a case. Control circuitry 28 can detect when contacts S2 are mated with case contacts and when ear buds 24 are receiving power from a power source in the case. Control circuitry 28 may then conclude that ear buds 24 are in the storage case. Output from contact sensors can therefore provide information indicating when ear buds are located in the case and are not in the user's ear.

The accelerometer data from accelerometers 38 may be used to provide control circuitry 28 with motion context information. The motion context information may include information on the current orientation of an ear bud (sometimes referred to as the "pose" or "attitude" of the ear bud) and may be used to characterize the amount of motion experienced by an ear bud over a recent time history (the recent motion history of the ear bud).

Figure 4:
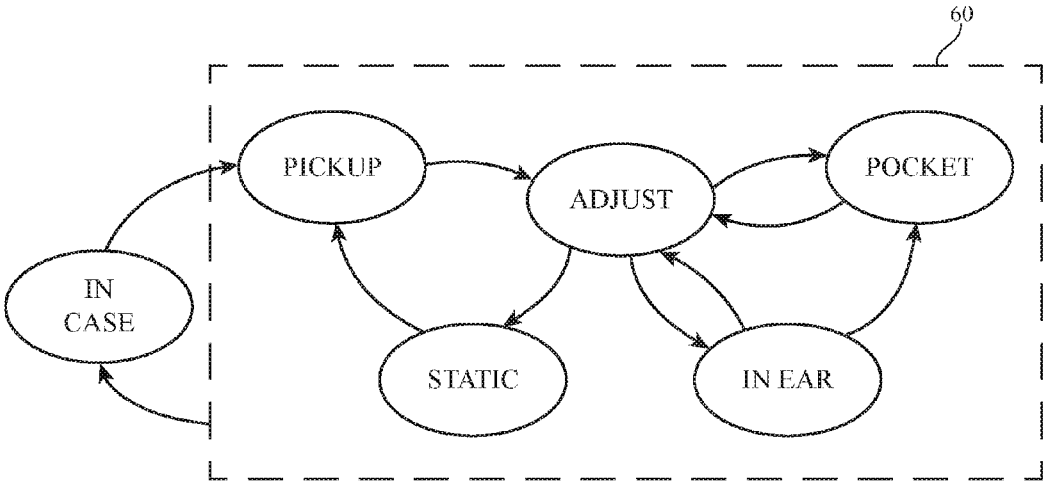
FIG. 4 is a state diagram illustrating illustrative states that may be associated with the operation of ear buds in accordance with an embodiment.

FIG. 4 shows an illustrative state machine of the type that may be implemented by control circuitry 28. The state machine of FIG. 4 has six states. State machines with more states or fewer states may also be used. The configuration of FIG. 4 is merely illustrative.

As shown in FIG. 4, ear buds 24 may operate in one of six states. In the IN CASE state, ear buds 24 are coupled to a power source such as a battery in a storage case or are otherwise coupled to a charger. Operation in this state may be detected using a contact sensor coupled to contacts S2. States 60 of FIG. 4 correspond to operations for ear buds 24 in which a user has removed ear buds 24 from the storage case.

The PICKUP state is associated with a situation in which an ear bud has recently been undocked from a power source. The STATIC state corresponds to an ear bud that has been stationary for an extended period of time (e.g., sitting on a table) but is not in a dock or case. The POCKET state corresponds to an earbud that placed in a pocket in an item of clothing, a bag, or other confined space. The IN EAR state corresponds to an earbud in a user's ear canal. The ADJUST state corresponds to conditions not represented by the other states.

Control circuitry 28 can discriminate between the states of FIG. 4 using information such as accelerometer information and optical proximity sensor information. For example, optical proximity sensor information may indicate when ear buds 24 are adjacent to external objects and accelerometer information may be used to help determine whether ear buds 24 are in a user's ear or are in a user's pocket.

Figure 5:
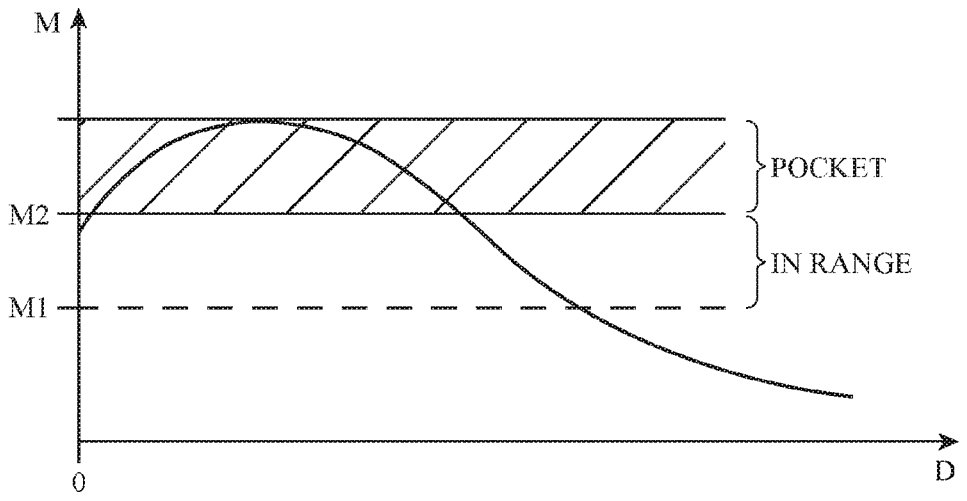
FIG. 5 is a graph showing illustrative output signals that may be associated with an optical proximity sensor in accordance with an embodiment.

FIG. 5 is a graph of illustrative optical proximity sensor output (M) as a function of distance D between the sensor (e.g., sensor S1 or sensor S2) and an external objects. At large values of D, M is low, because small amounts of the light emitted from the sensor are reflected from the external object back to the detector in the sensor. At moderate distances, the output of the sensor will be above lower threshold M1 and will be below upper threshold M2. This type of output may be produced when ear buds 24 are in the ears of a user (a condition that is sometimes referred to as being "in range"). When ear buds 24 are in a user's pocket, the output M of the sensor will typically saturate (e.g., the signal will be above upper threshold M2).

Figure 6:
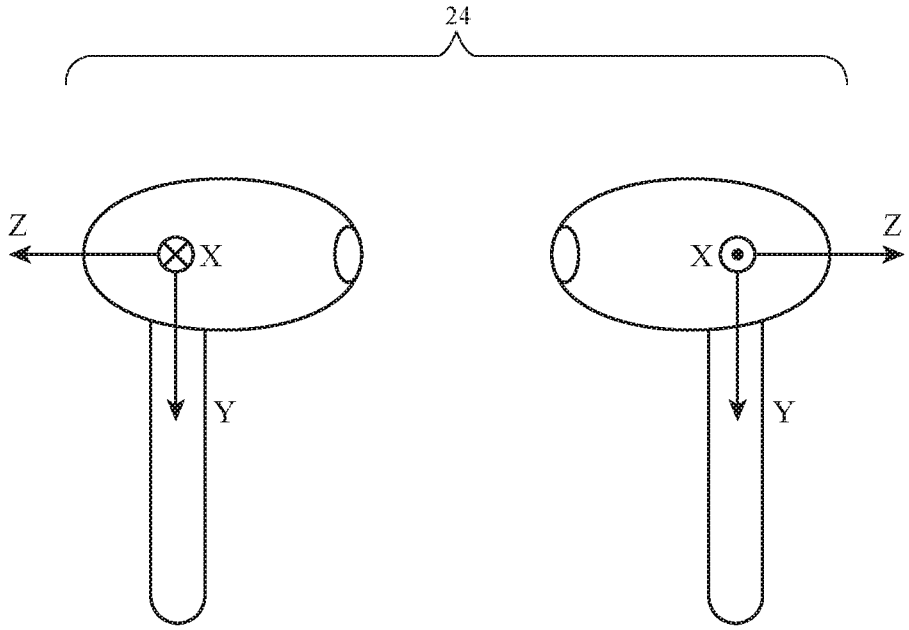
FIG. 6 is a diagram of illustrative ear buds in accordance with an embodiment.

Accelerometers 38 may sense acceleration along three different dimensions: an X axis, a Y axis, and a Z axis. The X, Y, and Z axes of ear buds 24 may, for example, be oriented as shown in FIG. 6. As shown in FIG. 6, the Y axis may be aligned with the stem of each ear bud and the Z axis may extend perpendicularly from the Y axis passing through the speaker in each ear bud.

When a user is wearing ear buds 24 (see, e.g., FIG. 7) while engaged in pedestrian motion (i.e. walking or running), ear buds 24 will generally be in a vertical orientation so that the stems of ear buds 24 will point downwards. In this situation, the predominant motion of ear buds 24 will be along the Earth's gravity vector (i.e., the Y axis of each ear bud will be pointed towards the center of the Earth) and will fluctuate due the bobbing motion of the user's head. The X axis is horizontal to the Earth's surface and is oriented along the user's direction of motion (e.g., the direction in which the user is walking). The Z axis will be perpendicular to the direction in which the user is walking and will generally experience lower amounts of acceleration than the X and Y axes. When the user is walking, and wearing ear buds 24, the X-axis accelerometer output and Y-axis accelerometer output will show a strong correlation, independent of the orientation of ear buds 24 within the X-Y plane. This X-Y correlation can be used to identify in-ear operation of ear buds 24.

During operation, control circuitry 28 may monitor the accelerometer output to determine whether ear buds 24 are potentially resting on a table or are otherwise in a static environment. If it is determined that ear buds 24 are in the STATIC state, power can be conserved by deactivating some of the circuitry of ear buds 24. For example, at least some of the processing circuitry that is being used to process proximity sensor data from sensors S1 and S2 may be powered down. Accelerometers 38 may generate interrupts in the event that movement is detected. These interrupts may be used to awaken the powered-down circuitry.

Figure 7:
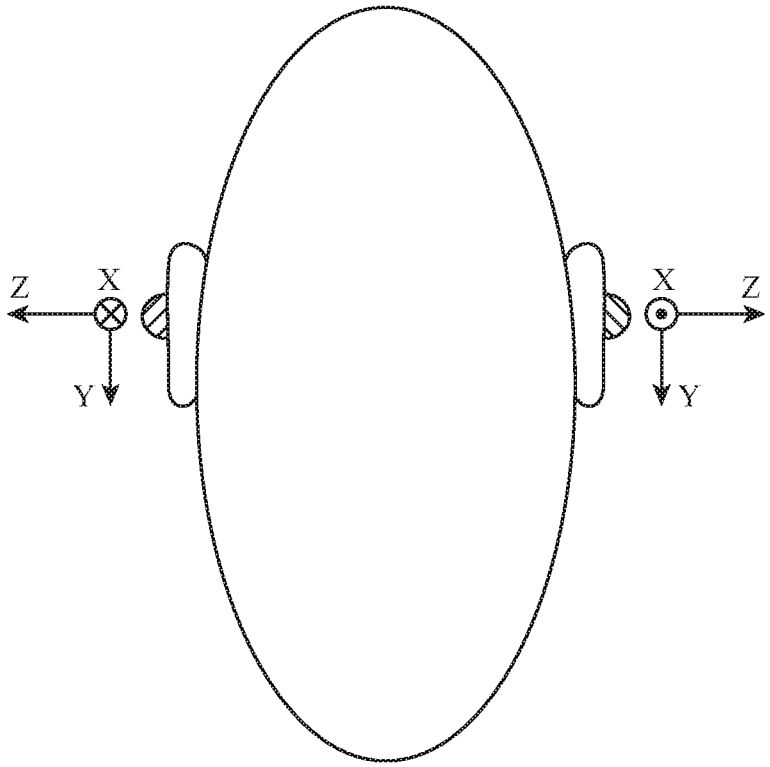
FIG. 7 is a diagram of illustrative ear buds in the ears of a user in accordance with an embodiment.
Figure 8:
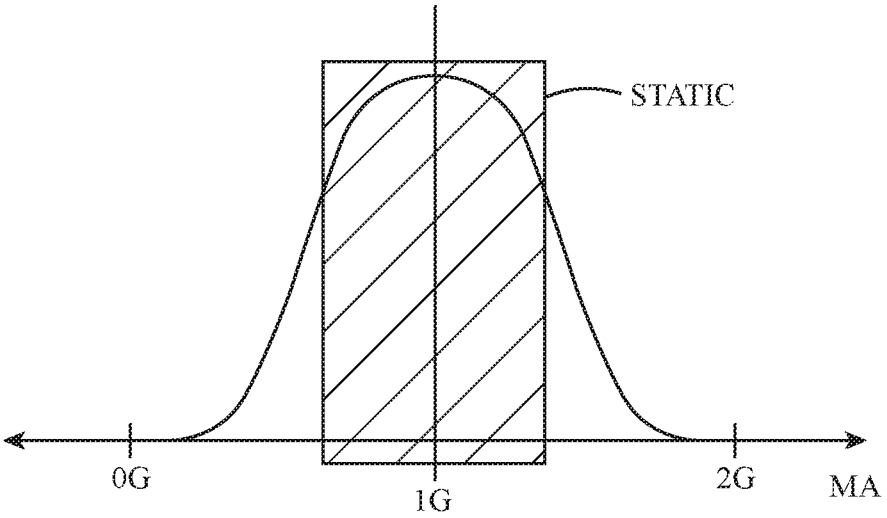
FIG. 8 is a graph showing how illustrative accelerometer output may be centered about a mean value in accordance with an embodiment.

If a user is wearing ear buds 24 but is not moving significantly, acceleration will mostly be along the Y axis (because the stem of the earbuds is generally pointing downwards as shown in FIG. 7). In conditions where ear buds 24 are resting on a table, X-axis accelerometer output will predominate. In response to detecting that X-axis output is high relative to Y-axis and Z-axis output, control circuitry 28 may process accelerometer data that covers a sufficiently long period of time to detect movement of the ear buds. For example, control circuitry 28 can analyze the accelerometer output for the ear buds over a period of 20 s, 10-30 s, more than 5 s, less than 40 s, or other suitable time period. If, as shown in FIG. 8, the measured accelerometer output MA does not vary too much during this time period (e.g., if the accelerometer output MA varies in magnitude within a three standard deviations of 1 g or other mean accelerometer output value), control circuitry 28 can conclude that an ear bud is in the STATIC state. If there is more motion, control circuitry 28 may analyze pose information (information on the orientation of ear buds 24) to help identify the current operating state of ear buds 24.

When control circuitry 28 detects motion while ear buds 24 are in the STATIC state, control circuitry 28 can transition to the PICKUP state. The PICKUP state is a temporary wait state (e.g., a period of 1.5 s, more than 0.5 s, less than 2.5 s, or other appropriate time period) that may be imposed to avoid false positives in the IN EAR state (e.g., if a user is holding ear bud 24 in the user's hand, etc.). When the PICKUP state expires, control circuitry 28 can automatically transition to the ADJUST state.

While in the ADJUST state, control circuitry 28 can process information from the proximity sensors and accelerometers to determine whether ear buds 24 are resting on a table or other surface (STATIC), in a user's pocket (POCKET), or in the user's ears (IN EAR). To make this determination, control circuitry 28 can compare accelerometer data from multiple axes.

Figure 9:
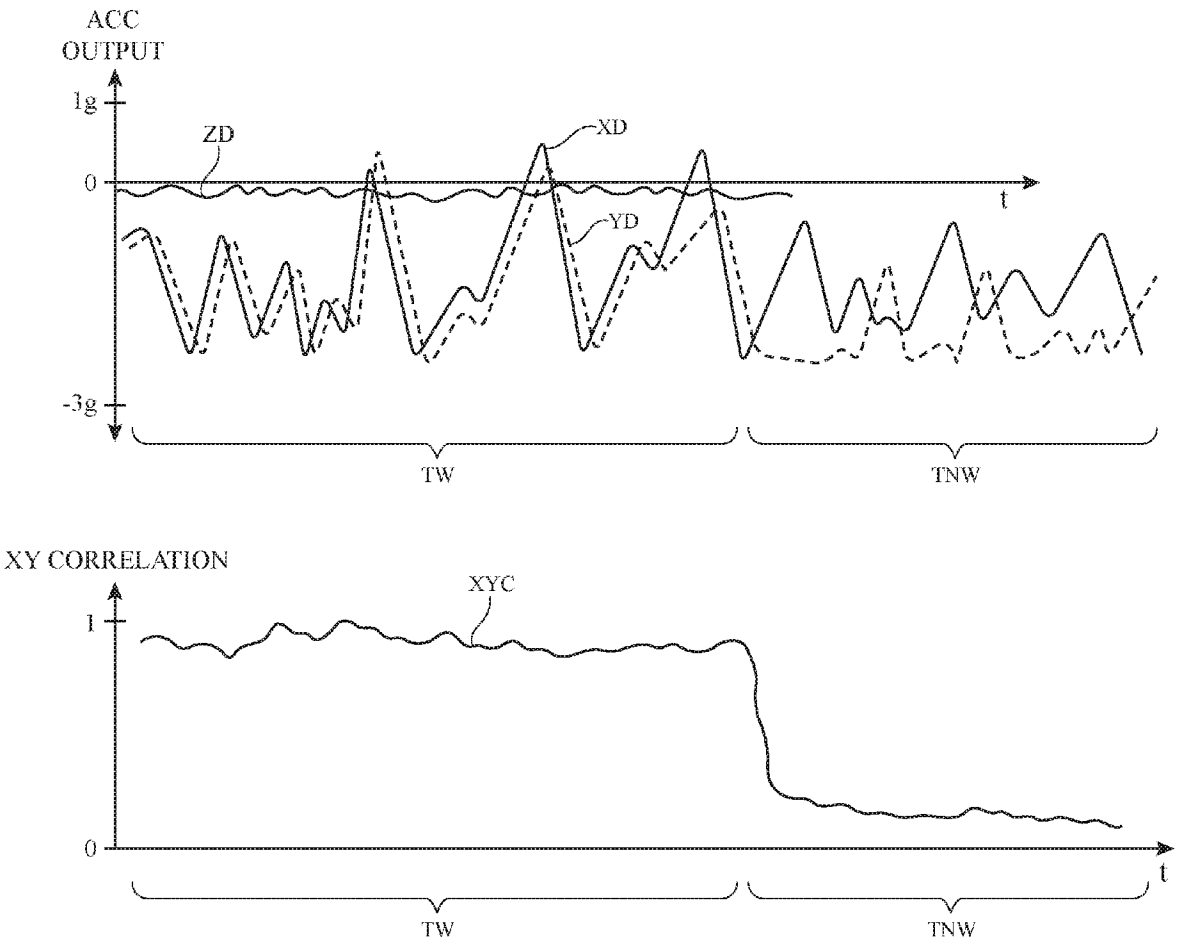
FIG. 9 is a graph showing illustrative accelerometer output and associated X-axis and Y-axis correlation information of the type that may be produced when earbuds are worn in the ears of a user in accordance with an embodiment.

The graphs of FIG. 9 show how motion of ear buds 24 in the X and Y axes may be correlated when ear buds 24 are in the ears of a user and the user is walking. The upper traces of FIG. 9 correspond to accelerometer output for the X, Y, and Z axes (accelerometer data XD, YD, and ZD, respectively). When a user is walking, ear buds 24 are oriented as shown in FIG. 7, so Z-axis data tends to be smaller in magnitude than the X and Y data. The X and Y data also tends to be well correlated (e.g., X-Y correlation signal XYC may be greater than 0.7, between 0.6 and 1.0, greater than 0.9, or other suitable value) when the user is walking (during time period TW) rather than when the user is not walking (period TNW). During period TNW, the X-Y correlation in the accelerometer data may, for example, be less than 0.5, less than 0.3, between 0 and 0.4, or other suitable value.

Figure 10:
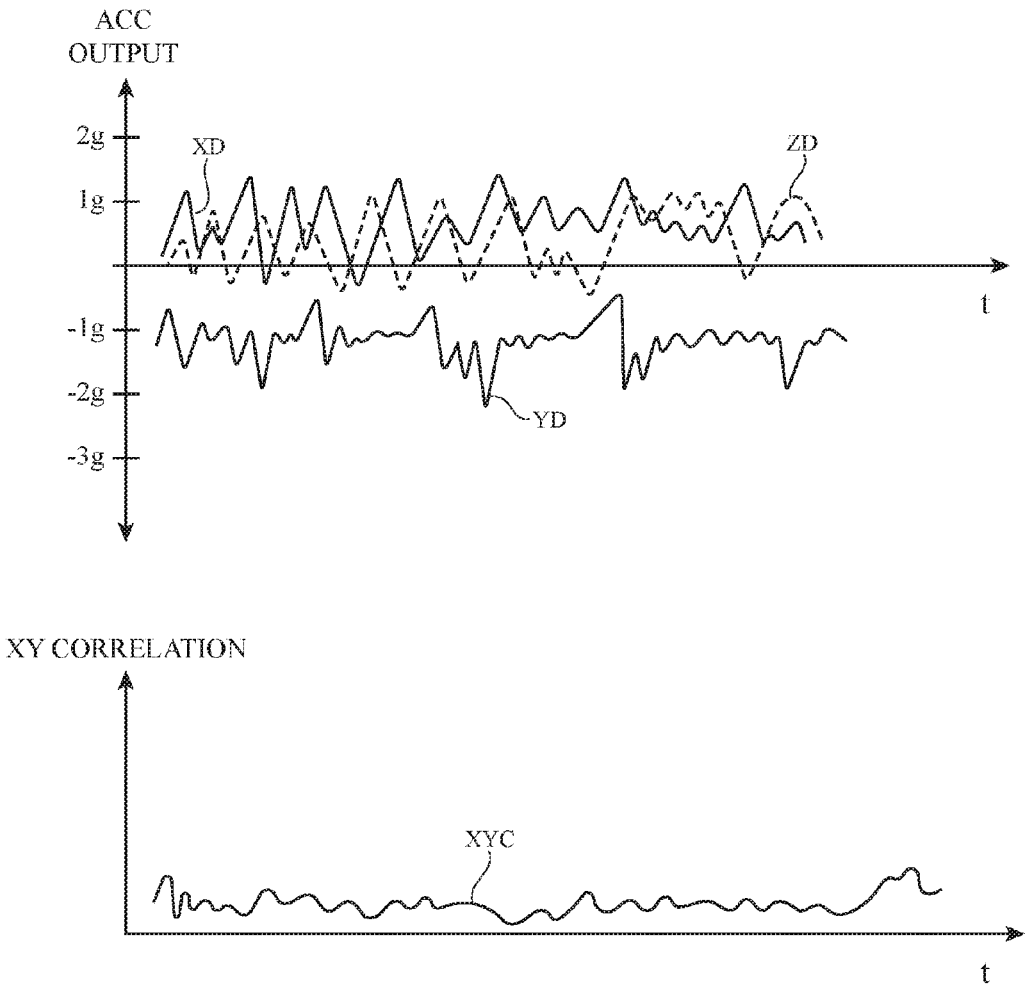
FIG. 10 is a graph showing illustrative accelerometer output and associated X-axis and Y-axis correlation information of the type that may be produced when earbuds are located in a pocket of a user's clothing in accordance with an embodiment.

The graphs of FIG. 10 show how motion of ear buds 24 in the X and Y axes may be uncorrelated when ear buds 24 are in the pocket of a user's clothing (e.g., when the user is walking or otherwise moving). The upper traces of FIG. 10 correspond to accelerometer output for the X, Y, and Z axes (accelerometer data XD, YD, and ZD, respectively) while ear buds 24 are in the user's pocket. When ear buds 24 are in a user's pocket, X and Y accelerometer output (signals XD and YD, respectively) will tend to be poorly correlated, as shown by XY correlation signal XYC in the lower trace of FIG. 10.

Figure 11:
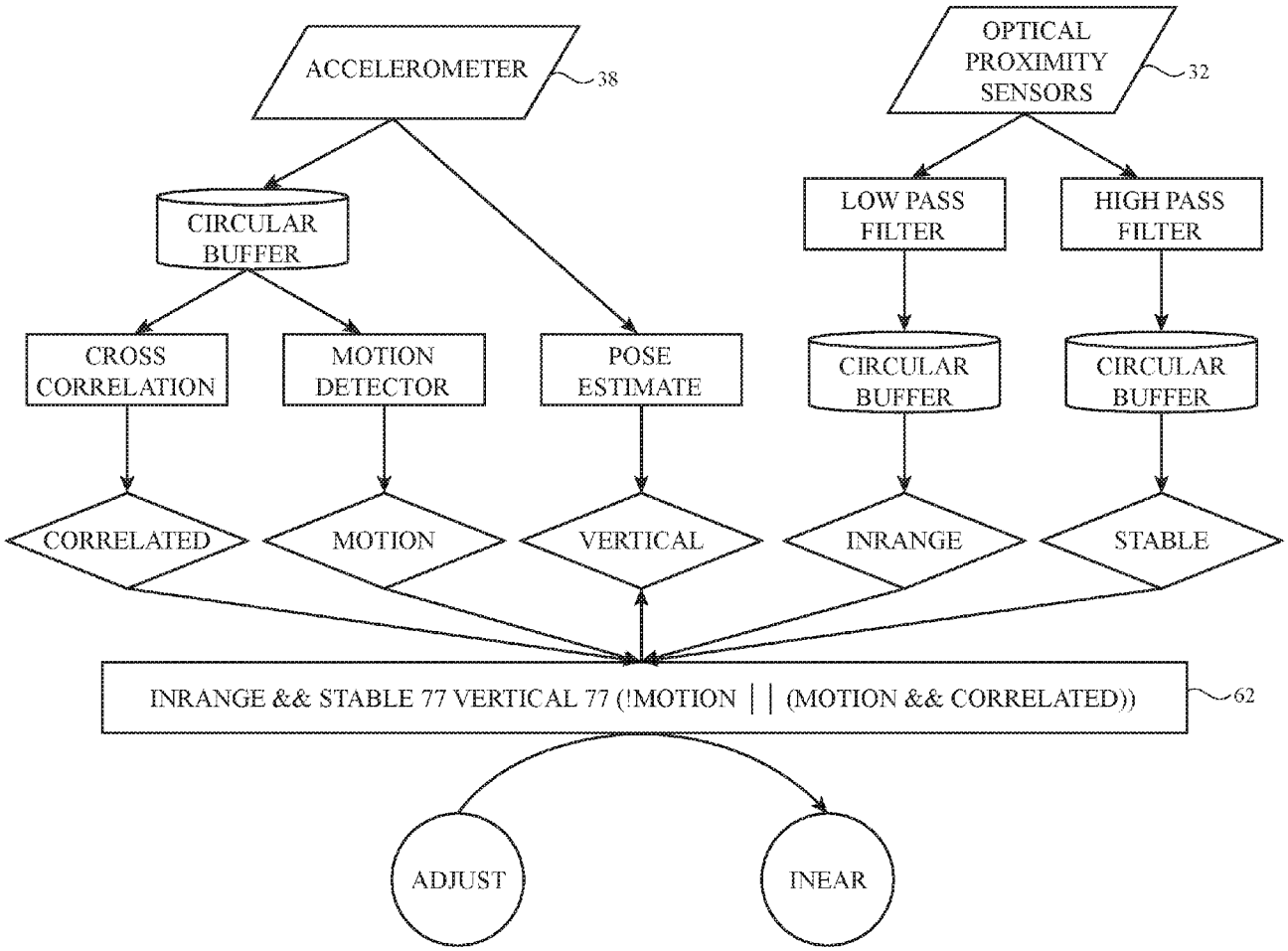
FIG. 11 is a diagram showing how sensor information may be processed by control circuitry in an ear bud to discriminate between operating states in accordance with an embodiment.

FIG. 11 is a diagram showing how control circuitry 28 can process data from accelerometers 38 and optical proximity sensors 32. Circular buffers (e.g., memory in control circuitry 28) may be used to retain recent accelerometer and proximity sensor data for use during processing. Optical proximity data may be filtered using low and high pass filters. Optical proximity sensor data may be considered to be in range when having values between thresholds such as thresholds M1 and M2 of FIG. 5. Optical proximity data may be considered to be stable when the data is not significantly varying (e.g., when the high-pass-filtered output of the optical proximity sensor is below a predetermined threshold). The verticality of the pose (orientation) of ear buds 24 may be determined by determining whether the gravity vector imposed by the Earth's gravity is primarily in the X-Y plane (e.g., by determining whether the gravity vector is in the X-Y plane within +/−30° or other suitable predetermined vertical orientation angular deviation limit). Control circuitry 28 can determine whether ear buds 24 are in motion or are not in motion by comparing recent motion data (e.g., accelerometer data averaged over a time period or other accelerometer data) to a predetermined threshold. The correlation of X-axis and Y-axis accelerometer data may also be considered as an indicator of whether ear buds 24 are in a user's ears, as described in connection with FIGS. 9 and 10.

Control circuitry 28 may transition the current state of ear buds 24 from the ADJUST state to the IN EAR state of the state machine of FIG. 4 based on information on whether the optical proximity sensor is in range, whether the optical proximity sensor signal is stable, whether ear buds 24 are vertical, whether X-axis and Y-axis accelerometer data is correlated, and whether ear buds 24 are vertical. As illustrated by equation 62, if ear buds 24 are in motion, ear buds 24 will be in the IN EAR state only if the X-axis and Y-axis data is correlated. If ear buds 24 are in motion and the XY data is correlated or if ear buds 24 are not in motion, ear buds 24 will be in the IN EAR state if optical sensor signal M is in range (between M1 and M2) and is stable and if ear buds 24 are vertical.

To transition from the ADJUST state to the POCKET state, optical sensor S1 or S2 should be saturated (output M greater than M2) over a predetermined time window (e.g., a window of 0.5 s, 0.1 to 2 s, more than 0.2 s, less than 3 s, or other suitable time period).

Once in the POCKET state, control circuitry 28 will transition ear buds 24 to the IN EAR state if the output from both sensors S1 and S2 goes low and the pose has changed to vertical. The pose of ear buds 24 may be considered to have changed to vertical sufficiently to transition out of the POCKET state if the orientation of the stems of ear buds 24 (e.g., the Y-axis of the accelerometer) is parallel to the gravity vector within +/−60° (or other suitable threshold angle). If S1 and S2 have not both gone low before the pose of ear buds 24 changes to vertical (e.g., within 0.5 s, 0.1-2 s, or other suitable time period), the state of ear buds 24 will not transition out of the POCKET state.

Ear buds 24 may transition out of the IN EAR state if the output of concha sensor S2 falls below a predetermined threshold for more than a predetermined time period (e.g., 0.1-2 s, 0.5 s, 0.3-1.5 s, more than 0.3 s, less than 5 s, or other suitable time period) or if there is more than a threshold amount of fluctuations in the output of both concha sensor S2 and tragus sensor S1 and the output of at least one of sensors S1 and S2 goes low. To transition from IN EAR to POCKET, ear buds 24 should have a pose that is associated with being located in a pocket (e.g., horizontal or upside down).

A user may supply tap input to ear buds 24. For example, a user may supply double taps, triple taps, single taps, and other patterns of taps by striking a finger against the housing of an ear bud to control the operation of ear buds 24 (e.g., to answer incoming telephone calls to device 10, to end a telephone call, to navigate between media tracks that are being played back to the user by device 10, to make volume adjustments, to play or to pause media, etc.). Control circuitry 28 may process output from accelerometers 38 to detect user tap input. In some situations, pulses in accelerometer output will correspond to tap input from a user. In other situations, accelerometer pulses may be associated with inadvertent tap-like contact with the ear bud housing and should be ignored.

Figure 12:
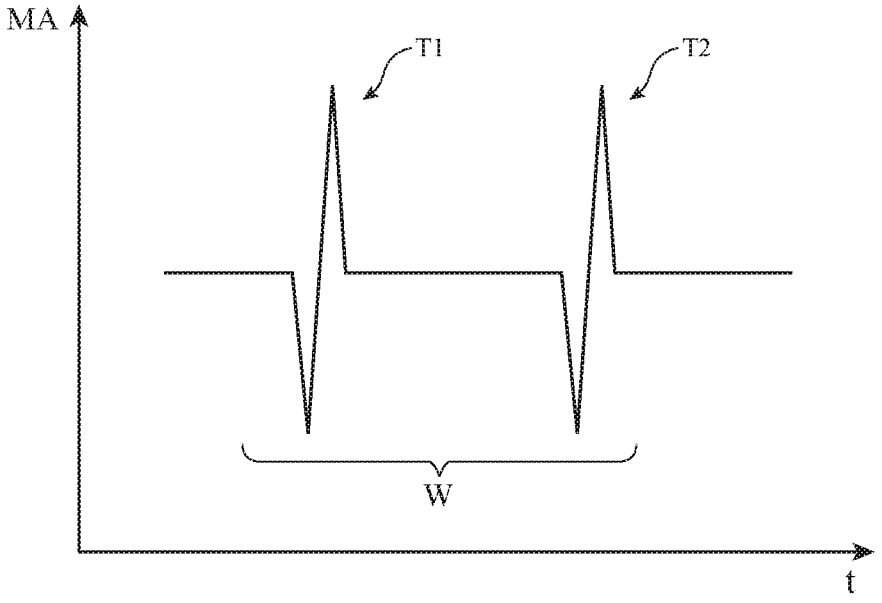
FIG. 12 is a diagram of illustrative accelerometer output containing pulses of the type that may be associated with tap input such as a double tap in accordance with an embodiment.

Consider, as an example, a scenario in which a user is supplying a double tap to one of ear buds 24. In this situation, the output MA from accelerometer 38 will exhibit pulses such as illustrative tap pulses T1 and T2 of FIG. 12. To be recognized as tap input, both pulses should be sufficiently strong and should occur within a predetermined time of each other. In particular, the magnitudes of pulses T1 and T2 should exceed a predetermined threshold and pulses T1 and T2 should occur within a predetermined time window W. The length of time window W may be, for example, 350 ms, 200-1000 ms, of 100 ms to 500 ms, more than 70 ms, less than 1500 ms, etc.

Control circuitry 28 may sample the output of accelerometer 38 at any suitable data rate. With one illustrative configuration, a sample rate of 250 Hz may be used. This is merely illustrative. Larger sample rates (e.g., rates of 250 Hz or more, 300 Hz or more, etc.) or smaller sample rates (e.g., rates of 250 Hz or less, 200 Hz or less, etc.) may be used, if desired.

Particularly when slower sample rates are used (e.g., less than 1000 Hz, etc.), it may sometimes be desirable to fit a curve (spline) to the sampled data points. This allows control circuitry 28 to accurately identify peaks in the accelerometer data even if the data has been clipped during the sampling process. Curve fitting will therefore allow control circuitry 28 to more accurately determine whether a pulse has sufficient magnitude to be considered an intentional tap in a double tap command from a user.

Figure 13:
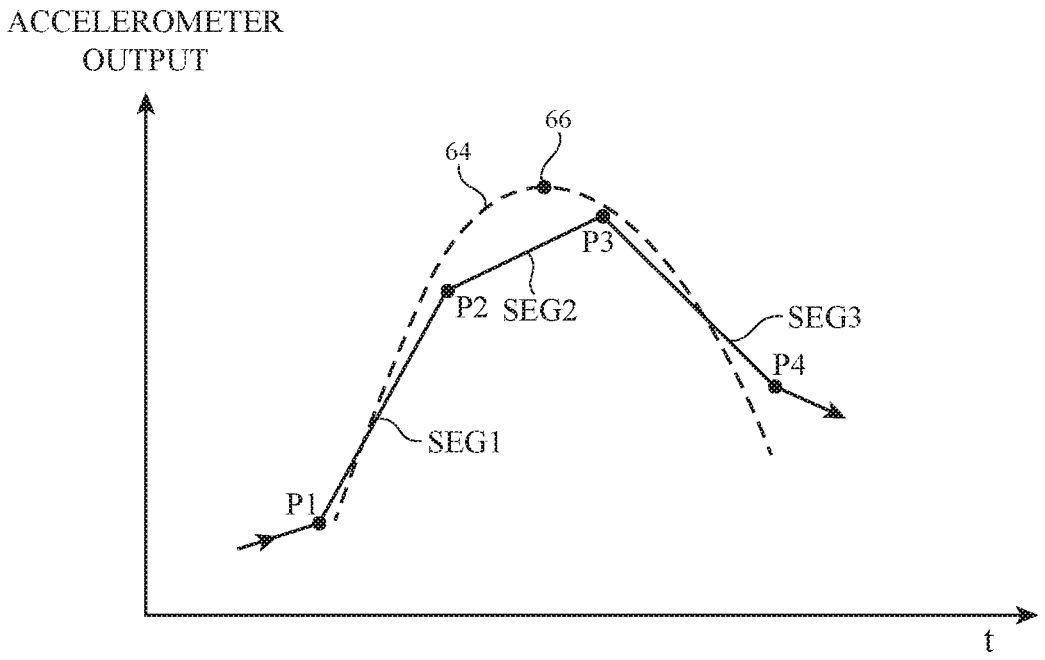
FIG. 13 is a diagram of an illustrative curve fitting process used for identifying accelerometer pulse signal peaks in sampled accelerometer data that exhibits clipping in accordance with an embodiment.

In the example of FIG. 13, control circuitry 28 has sampled accelerometer output to produce data points P1, P2, P3, and P4. After curve fitting curve 64 to points P1, P2, P3, and P4, control circuitry 28 can accurately identify the magnitude and time associated with peak 66 of curve 64, even though the accelerometer data associated with points P1, P2, P3, and P4 has been clipped.

As shown in the example of FIG. 13, curve-fit peak 66 may have a value that is greater than that of the largest data sample (e.g., point P3 in this example) and may occur at a time that differs from that of sample P3. To determine whether pulse T1 is an intentional tap, the magnitude of peak 66 may be compared to a predetermined tap threshold rather than the magnitude of point P3. To determine whether taps such as taps T1 and T2 of FIG. 12 have occurred within time window W, the time at which peak 66 occurs may be analyzed.

Figure 14:
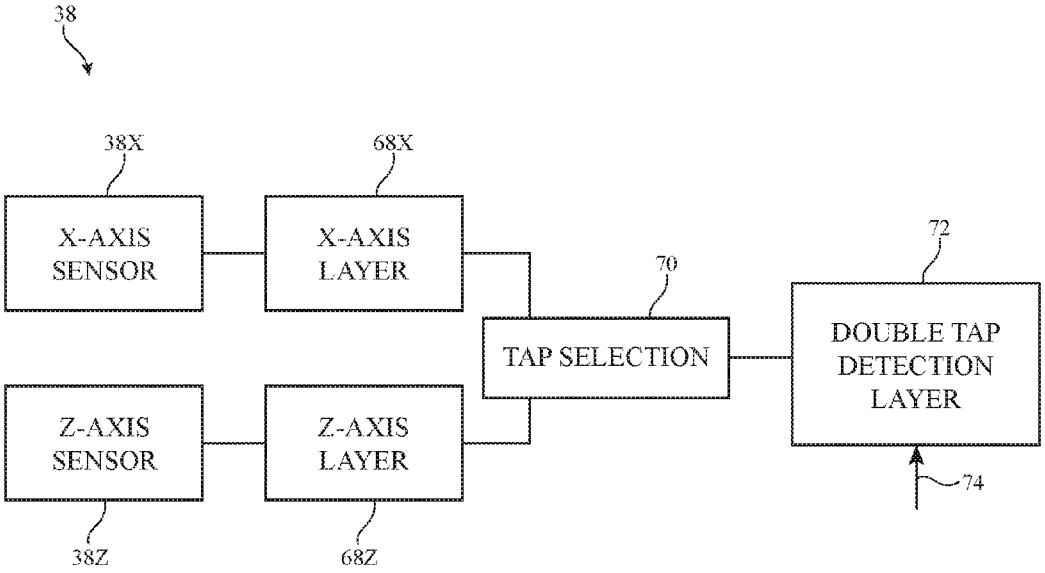
FIG. 14 is a diagram showing how ear bud control circuitry may perform processing operations on sensor data to identify double taps in accordance with an embodiment.

FIG. 14 shows illustrative processes that may be implemented by control circuitry 28 during tap detection operations. In particular, FIG. 14 shows how X-axis sensor data (e.g., from X-axis accelerometer 38X in accelerometer 38) may be processed by control circuitry processing layer 68X and shows how Z-axis sensor data (e.g., from Z-axis accelerometer 38Z in accelerometer 38) may be processed by control circuitry processing layer 68 68Z. Layers 68X and 68Z may be used to determine whether there has been a sign change (positive to negative or negative to positive) in the slope of the accelerometer signal. In the example of FIG. 13, segments SEG1 and SEG2 of the accelerometer signal have positive slopes. The positive slope of segment SEG2 changes to negative for segment SEG3.

Processors 68X and 68Z may also determine whether each accelerometer pulse has a slope greater than a predetermined threshold, may determine whether the width of the pulse is greater than a predetermined threshold, may determine whether the magnitude of the pulse is greater than a predetermined threshold, and/or may apply other criteria to determine whether an accelerometer pulse is potentially tap input from a user. If all of these constraints or other suitable constraints are satisfied, processor 68X and/or 68Z may supply corresponding pulse output to tap selector 70. Tap selector 70 may provide double tap detection layer 72 with the larger of the two tap signals from processors 68X and 68Z (if both are present) or the tap signal from an appropriate one of processors 68X and 68Z if only one signal is present.

Tap selector 70 may analyze the slopes of segments such as SEG1, SEG2, and SEG3 to determine whether the accelerometer has been clipped and is therefore in need of curve fitting. In situations in which the signal has not been clipped, the curve fitting process can be omitted to conserve power. In situations in which curve fitting is needed because samples in the accelerometer data have been clipped, a curve such as curve 64 may be fit to the samples (see, e.g., points P1, P2, P3, and P4).

To determine whether there is an indication of clipping, control circuitry 28 (e.g., processors 68X and 68Z) may determine whether the first pulse segment (e.g., SEG1 in the present example) has a slope magnitude greater than a predetermined threshold (indicating that the first segment is relatively steep), whether the second segment has a slope magnitude that is less than a predetermined threshold (indicating that the second segment is relatively flat), and whether the third segment has a slope magnitude that is greater than a predetermined threshold (indicating that the third slope is steep). If all of these criteria or other suitable criteria are satisfied, control circuitry 28 can conclude that the signal has been clipped and can curve fit curve 64 to the sampled points. By curve fitting selectively in this way (only curve fitting curve 64 to the sample data when control circuitry 28 determines that the sample data is clipped), processing operations and battery power can be conserved.

Double-tap detection processor 72 may identify potential double taps by applying constraints to the pulses. To determine whether a pair of pulses corresponds to a potential double tap, processor 72 may, for example, determine whether the two taps (e.g., taps T1 and T2 of FIG. 12) have occurred within a predetermined time window W (e.g., a window of length 120 to 350 ms, a window of length 50-500 ms, etc.). Processor 72 may also determine whether the magnitude of the second pulse (T2) is within a specified range of the magnitude of the first pulse (T1). For example, processor 72 may determine whether the ratio of T2/T1 is between 50% and 200% or is between 30% and 300% or other suitable range of T2/T1 ratios. As another constraint (sometimes referred to as a "put down" constraint because it is sensitive to whether or not a user has place ear bud 24 on a table), processor 72 may determine whether the pose (orientation) of ear bud 24 has changed (e.g., whether the angle of ear bud 24 has changed by more than 45° or other suitable threshold and whether the final pose angle (e.g., the Y axis) of ear bud 24 is within 30° of horizontal (parallel to the surface of the Earth). If taps T1 and T2 occur close enough in time, have relative sizes that are not too dissimilar, and if the put-down condition is false, processor 72 may provisionally identify an input event as being a double tap.

Double tap detection processor 72 may also analyze the processed accelerometer data from processor 72 and optical proximity sensor data on input 74 from sensors S1 and S2 to determine whether the received input event corresponds to a true double tap. The optical data from sensors S1 and S2 may, for example, be analyzed to determine whether a potential double tap that has been received from the accelerometer is actually a false double tap (e.g., vibrations created inadvertently when a user adjusts the position of ear buds 24 in the user's ears) and should be ignored.

Inadvertent tap-like vibrations that are picked up by the accelerometer (sometimes referred to as false taps) may be distinguished from tap input by determining whether fluctuations in the optical proximity sensor signal are ordered or disordered. If a user intentionally taps ear buds 24, the user's finger will approach and leave the vicinity of the optical sensors in an ordered fashion. Resulting ordered fluctuations in the optical proximity sensor output may be recognized as being associated with intentional movement of the user's finger towards the housing of an ear bud. In contrast, unintentional vibrations that arise when a user contacts the housing of an ear bud while moving the ear bud within the user's ear to adjust the fit of the ear bud tend to be disordered. This effect is illustrated in FIGS. 15-20.

Figure 15:
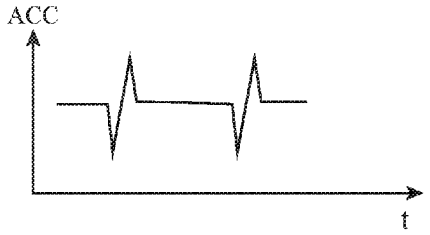
FIGS. 15, 16, and 17 are graphs of accelerometer and optical sensor data for an illustrative true double tap event in accordance with an embodiment.
Figure 16:
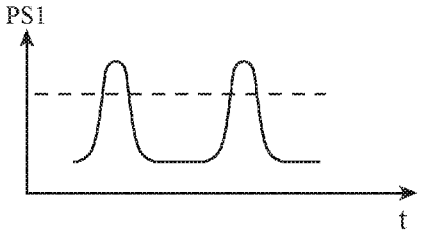
Figure 17:
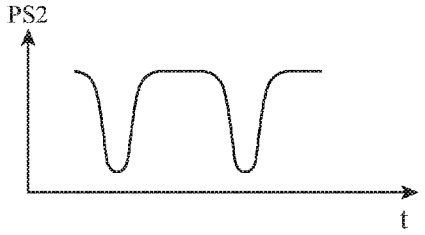

In the example of FIGS. 15, 16, and 17, a user is supplying an ear bud with an intentional double tap input. In this situation, the output of accelerometer 38 produces two pulses T1 and T2, as shown in FIG. 15. Because the user's finger is moving towards and away from the ear bud (and therefore towards and away from positions adjacent to sensors S1 and S2), the output PS1 of sensor S1 (FIG. 16) and the output PS2 of sensor S2 (FIG. 17) tends to be well ordered as illustrated by the distinct shapes of the pulses in the PS1 and PS2 signals.

Figure 18:
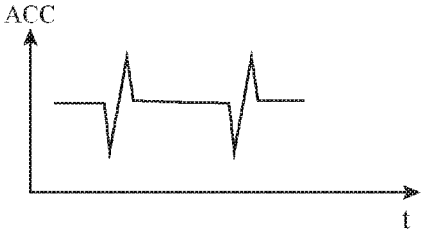
FIGS. 18, 19, and 20 are graphs of accelerometer and optical sensor data for an illustrative false double tap event in accordance with an embodiment.
Figure 19:
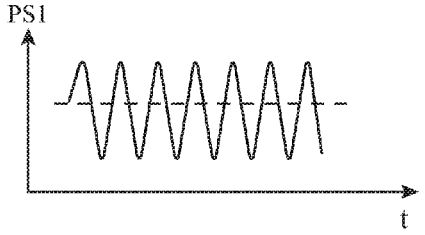
Figure 20:
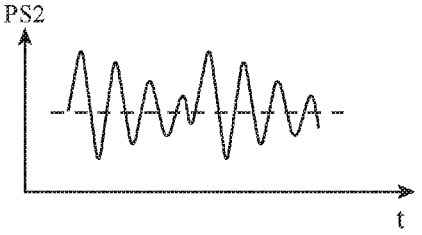

In the example of FIGS. 18, 19, and 20, in contrast, the user is holding on to the ear bud while moving the ear bud within the user's ear to adjust the fit of the earbud. In this situation, the user may accidentally create tap-like pulses T1 and T2 in the accelerometer output, as shown in FIG. 18. However, because the user is not deliberately moving the user's fingers towards and away from ear bud 24, sensor outputs PS1 and PS2 are disordered, as shown by the noisy signal traces in FIGS. 19 and 20.

Figure 21:
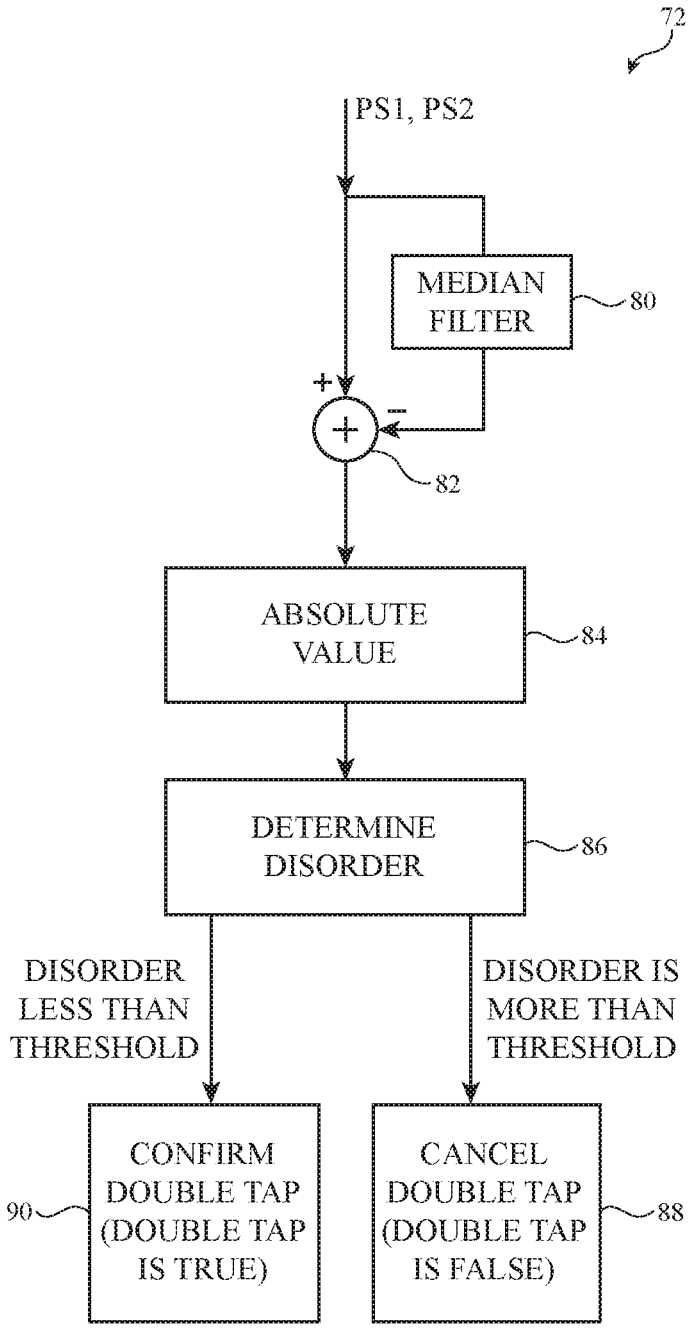
FIG. 21 is a diagram of illustrative processing operations involved in discriminating between true and false double taps in accordance with an embodiment.

FIG. 21 is a diagram of illustrative processing operations that may be implemented in double tap detection processor (double tap detector) 72 running on control circuitry 28 to distinguish between double taps of the type illustrated in FIGS. 15, 16, and 17 (or other tap input) and inadvertent tap-like accelerometer pulses (false double taps) of the type illustrated in FIGS. 18, 19, and 20.

As shown in FIG. 21, detector 72 may use median filter 80 to determine an average (median) of each optical proximity sensor signal. These median values may be subtracted from the received optical proximity sensor data using subtractor 82. The absolute value of the output from subtractor 82 may be provided to block 86 by absolute value block 84. During the operations of block 86, the optical signals may be analyzed to produce a corresponding disorder metric (a value that represents how much disorder is present in the optical signals). As described in connection with FIGS. 15-20, disordered optical signals are indicative of false double taps and ordered signals are indicative of true double taps.

With one illustrative disorder metric computation technique, block 86 may analyze a time window that is centered around the two pulses T1 and T2 and may compute the number of peaks in each optical sensor signal that exceed a predetermined threshold within that time window. If the number of peaks above the threshold value is more than a threshold amount, the optical sensor signal may be considered to be disordered and the potential double tap will be indicated to be false (block 88). In this situation, processor 72 ignores the accelerometer data and does not recognize the pulses as corresponding to tap input from a user. If the number of peaks above the threshold value is less than a threshold amount, the optical sensor signal may be considered to be ordered and the potential double tap can be confirmed as being a true double tap (block 90). In this situation, control circuitry 28 may take suitable action in response to the tap input (e.g., change a media track, adjust playback volume, answer a telephone call, etc.).

With another illustrative disorder metric computation technique, disorder can be determined by computing entropy E for the accelerometer signal within the time window centered around the two pulses using equations (1) and (2), $$E=\Sigma_i -p_i \log(p_i) \quad (1)$$

$$p_i=x_i/\mathrm{sum}(x_i) \quad (2)$$

where $x_i$ is the optical signal at time i within the window. If the disorder metric (entropy E in this example) is more than a threshold amount, the potential double tap data can be ignored (e.g., a false double tap may be identified at block 88), because this data does not correspond to a true double tap event. If the disorder metric is less than a threshold amount, control circuitry 28 can confirm that the potential double tap data corresponds to intentional tap input from a user (block 90) and appropriate actions can be taken in response to the double tap. These processes can be used to identify any suitable types of taps (e.g., triple taps, etc.). Double tap processing techniques have been described as an example.

The foregoing is merely illustrative and various modifications can be made by those skilled in the art without departing from the scope and spirit of the described embodiments. The foregoing embodiments may be implemented individually or in any combination.

What is claimed is:

1. A wireless ear bud configured to operate in a plurality of operating states including a current operating state, comprising:
- a housing;
- a speaker in the housing;
- at least one optical proximity sensor in the housing;
- an accelerometer in the housing that produces output signals including first, second, and third outputs corresponding to first, second, and third respective orthogonal axes; and
- control circuitry that:
  - identifies the current operating state based at least partly on whether the first and second outputs are correlated; and
  - identifies double tap input by detecting first and second pulses in the output signals from the accelerometer.

2. The wireless ear bud defined in claim 1 wherein the housing has a stem and wherein the second axis is aligned with the stem.

3. The wireless ear bud defined in claim 2 wherein the control circuitry identifies the current operating state based at least partly on whether the stem is vertical.

4. The wireless ear bud defined in claim 3 wherein the control circuitry identifies the current operating state based at least partly on whether the first, second, and third outputs indicate that the housing is moving.

5. The wireless ear bud defined in claim 4 wherein the control circuitry identifies the current operating state based at least partly on proximity sensor data from the optical proximity sensor.

6. The wireless ear bud defined in claim 5 wherein the control circuitry applies a low pass filter to the proximity sensor data and applies a high pass filter to the proximity sensor data.

7. The wireless ear bud defined in claim 6 wherein the control circuitry identifies the current operating state based at least partly on whether the proximity sensor data to which the high pass filter has been applied varies by more than a threshold amount.

8. The wireless ear bud defined in claim 7 wherein the control circuitry identifies the current operating state based at least partly on whether the proximity sensor data to which the low pass filter has been applied is more than a first threshold and less than a second threshold.

9. The wireless ear bud defined in claim 1 wherein the control circuitry identifies the current operating state based at least partly on proximity sensor data from the optical proximity sensor.

10. The wireless ear bud defined in claim 1 wherein the control circuitry identifies tap input based on the output signals.

11. The wireless ear bud defined in claim 10 wherein the control circuitry samples the output signals to produce samples and curve fits a curve to the samples.

12. The wireless ear bud defined in claim 11 wherein the control circuitry applies the curve fit to the samples based on whether the samples have been clipped.

13. The wireless ear bud defined in claim 1 wherein the control circuitry identifies false double taps based at least partly on the proximity sensor data from the optical proximity sensor.

14. The wireless ear bud defined in claim 13 wherein the control circuitry identifies the false double taps by determining a disorder metric for the proximity sensor data.

15. A wireless ear bud, comprising:
- a housing;
- a speaker in the housing;
- an optical proximity sensor in the housing that produces optical proximity sensor output;
- an accelerometer in the housing that produces accelerometer output; and
- control circuitry that:
  - identifies a double tap on the housing by detecting first and second pulses in the accelerometer output during respective first and second time windows; and
  - determines whether the double tap is a true double tap or a false double tap based on the optical proximity sensor output during the first and second time windows.

16. The wireless ear bud defined in claim 15 wherein the control circuitry processes samples in the accelerometer output to determine whether the samples have been clipped and fits a curve to the samples based on whether the samples have been clipped.

17. A wireless ear bud, comprising:

a housing;

a speaker in the housing;

an optical proximity sensor in the housing that produces optical proximity sensor output;

an accelerometer in the housing that produces accelerometer output; and control circuitry that:

processes samples of the accelerometer output to determine whether the samples have been clipped; and identifies double taps on the housing at least partly by selectively fitting a curve to the samples in response to determining that the samples have been clipped, wherein the control circuitry identifies the double taps on the housing by detecting first and second pulses in the accelerometer output.

* * * * *